US011896060B2

(12) United States Patent
Yu et al.

(10) Patent No.: US 11,896,060 B2
(45) Date of Patent: Feb. 13, 2024

(54) ELECTRONIC CIGARETTE CONTROL METHOD, ELECTRONIC CIGARETTE DEVICE, AND COMPUTER STORAGE MEDIUM

(71) Applicant: SHENZHEN FIRST UNION TECHNOLOGY CO., LTD., Shenzhen (CN)

(72) Inventors: Zongping Yu, Shenzhen (CN); Yonghai Li, Shenzhen (CN); Zhongli Xu, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 569 days.

(21) Appl. No.: 17/265,247

(22) PCT Filed: Aug. 5, 2019

(86) PCT No.: PCT/CN2019/099293
§ 371 (c)(1),
(2) Date: Feb. 2, 2021

(87) PCT Pub. No.: WO2020/029923
PCT Pub. Date: Feb. 13, 2020

(65) Prior Publication Data

US 2021/0298364 A1 Sep. 30, 2021

(30) Foreign Application Priority Data

Aug. 7, 2018 (CN) ..... 201810889905.7

(51) Int. Cl.
*A24F 13/00* (2006.01)
*A24F 40/57* (2020.01)
*A24F 40/53* (2020.01)

(52) U.S. Cl.
CPC ..... *A24F 40/57* (2020.01); *A24F 40/53* (2020.01)

(58) Field of Classification Search
CPC ..... A24F 40/465; A24F 40/51; A24F 40/57
See application file for complete search history.

(56) References Cited

U.S. PATENT DOCUMENTS 10,081,531 B2 * 9/2018 Murison ..... B67D 7/42
2014/0366898 A1 * 12/2014 Monsees ..... A24F 40/30 131/329

FOREIGN PATENT DOCUMENTS

CN 205757185 U 12/2016
CN 107296301 A 10/2017
(Continued)

*Primary Examiner* — Neil Abrams
(74) *Attorney, Agent, or Firm* — PROI Intellectual Property US; Klaus Michael Schmid

(57) ABSTRACT

The present disclosure relates to electronic cigarettes, and in particular to a control method of an electronic cigarette and an electronic cigarette. The method includes: activating an electromagnetic heating component to output a predetermined output power at a first stage, so that a heating device heats up; feedback controlling the output power of the electromagnetic heating component through a first PID algorithm according to the temperature information of the heating device and a preset preheating temperature, so that the heating device reaches the preheating temperature; and after the heating device reaches the preheating temperature, adjusting the output power of the electromagnetic heating component at a second stage, so that the heating device keeps a target smoking temperature, the target smoking temperature being less than the preheating temperature. The control method of the electronic cigarette provided in the embodiment adopts a combination of PID algorithms and electromagnetic heating.

18 Claims, 6 Drawing Sheets

(56) References Cited

FOREIGN PATENT DOCUMENTS

| | | | |
|---|---|---|---|
| CN | 206808677 | U | 12/2017 |
| EP | 3061358 | A1 | 8/2016 |

* cited by examiner

ELECTRONIC CIGARETTE CONTROL METHOD, ELECTRONIC CIGARETTE DEVICE, AND COMPUTER STORAGE MEDIUM

This application claims priority to Chinese Patent Application entitled "Control method of electronic cigarette and electronic cigarette" with application number of 201810889905.7, submitted to China National Intellectual Property Administration on Aug. 7, 2018, the entire contents of which are incorporated herein by reference.

TECHNICAL FIELD

The present disclosure relates to the technical field of electronic cigarettes, and in particular to a control method of an electronic cigarette, an electronic cigarette and a computer storage medium.

BACKGROUND

With the development of heated non-combustion smoking articles, many non-combustion type heated low-temperature baking smoking sets appear on the market.

The inventor finds in the process of implementing the present disclosure that: for existing low-temperature baking smoking sets, due to the limits of heating modes and heating control modes, it takes a long time to reach a target preheating temperature of the smoking article, which generally needs about 20 to 40 seconds. Therefore, users need to wait a long time before smoking the electronic cigarette, and the smoking effect is not good.

Therefore, conventional electronic cigarettes cannot provide aerosol in time, and affect the usage experiences of electronic cigarettes.

SUMMARY

One purpose of the embodiment of the present disclosure is to provide a control method of an electronic cigarette and an electronic cigarette, so as to solve the technical problems in conventional electronic cigarettes that a long time is needed before inhaling and the inhaling effect is not good.

In order to solve the above technical problems, one technical scheme of the present disclosure is provided as follows. A control method of an electronic cigarette is provided, which is used for controlling an electromagnetic heating component to heat a smoking article to produce an aerosol, the electromagnetic heating component at least including an induction coil and a heating device. The method includes: determining a preheating temperature, the preheating temperature being greater than a critical temperature at which a tobacco material in the smoking article is heated to aerosolize; activating the electromagnetic heating component to output a predetermined output power at a first stage, so that the heating device heats up; receiving temperature information of the heating device collected in real time by a temperature sensor, feedback controlling the output power of the electromagnetic heating component through a first PID algorithm according to the temperature information and the preset preheating temperature, so that the heating device reaches the preheating temperature; and after the heating device reaches the preheating temperature, adjusting the output power of the electromagnetic heating component at a second stage, so that the heating device keeps a target smoking temperature, the target smoking temperature being less than the preheating temperature.

Optionally, the first PID algorithm is a PID algorithm with a rapid response speed, and the first stage has a duration of 3 to 4 seconds.

Optionally, the step of activating the electromagnetic heating component to output a predetermined output power at a first stage includes: controlling the induction coil to generate an alternating magnetic field of a first frequency in a first stage, so that the electromagnetic heating component outputs a predetermined output power; and the step of adjusting the output power of the electromagnetic heating component at a second stage specifically includes: controlling the induction coil to generate an alternating magnetic field of a second frequency in a second stage, so as to control the output power of the electromagnetic heating component, the second frequency being less than the first frequency.

Optionally, the preheating temperature is 200 to 350 degrees centigrade.

Optionally, the method further includes: receiving a start instruction coming from a user, and activating the electromagnetic heating component to output a predetermined output power according to the start instruction.

Optionally, the step of adjusting the output power of the electromagnetic heating component at a second stage so that the heating device keeps a target smoking temperature specifically includes: controlling the heating device to keep a target smoking temperature during a smoking process through a second PID algorithm in a second stage; the smoking process being divided into a plurality of phases, each of which has a corresponding target smoking temperature, and the second PID algorithm being a PID algorithm with a slow response speed.

Optionally, the step of controlling the heating device to keep a target smoking temperature during a smoking process through a second PID algorithm specifically includes: collecting temperature information of the heating device at a predetermined sampling period through the temperature sensor; and feedback controlling the output power of the electromagnetic heating component through a second PID algorithm according to the temperature information and the target smoking temperature at the current phase, so that the heating device reaches the target smoking temperature.

Optionally, the step of feedback controlling the output power of the heating device through a first PID algorithm or a second PID algorithm specifically includes: calculating a first difference value between the current temperature information and the preheating temperature; adjusting a duty ratio of a control signal through a preset first PID algorithm according to the first difference value; and outputting the control signal to the electromagnetic heating component to control the output power; or, calculating a second difference value between the current temperature information and the target smoking temperature; adjusting a duty ratio of a control signal through a preset second PID algorithm according to the second difference value; and outputting the control signal to the electromagnetic heating component to control the output power.

Optionally, the response speed of the first PID algorithm is greater than the response speed of the second PID algorithm.

In order to solve the above technical problems, the present disclosure employs another technical scheme as follows. An electronic cigarette is provided. The electronic cigarette includes: a temperature sensor, which is used for detecting temperature information of a heating device; an electromagnetic heating component, which is used for outputting a power to heat a smoking article placed in the electronic cigarette; the electromagnetic heating component at least including an induction coil and a heating device; a controller, which is connected to the temperature sensor and the electromagnetic heating component respectively, and is used for feedback controlling the output power of the electromagnetic heating component through a first PID algorithm according to the temperature information and a preset preheating temperature for the heating device, so that the heating device reaches the preheating temperature.

Optionally, the controller specifically is used for feedback controlling the output power of the electromagnetic heating component through the first PID algorithm, so that the heating device reaches the preheating temperature, and is used for feedback controlling the electromagnetic heating component to keep a target smoking temperature through the second PID algorithm.

Optionally, the electronic cigarette further includes a start switch, wherein the start switch is connected to the controller, and is used for receiving a start instruction coming from a user and transmitting the start instruction to the controller, so that the controller starts, according to the start instruction, the electromagnetic heating component to output a predetermined output power.

Optionally, the controller includes:

at least one processor; and a memory in communication connection with the at least one processor; wherein the memory stores an instruction that can be executed by the at least one processor, and the instruction is executed by the at least one processor so that the at least one processor can execute the steps executed by the controller.

In order to solve the above technical problems, the present disclosure employs another technical scheme as follows. A computer storage medium is provided, wherein the computer storage medium stores an electronic cigarette control program, which, when executed by a processor, implements the steps in the control method of the electronic cigarette described above.

In order to solve the above technical problems, the present disclosure employs another technical scheme as follows. A computer program product is provided, wherein the computer program product includes a computer program stored in a nonvolatile computer readable storage medium, and the computer program includes a program instruction, which, when executed by a computer, causes the computer to execute the method described above.

The control method of the electronic cigarette provided in the embodiment of the present disclosure adopts a combination of PID algorithms and electromagnetic heating, thereby effectively reducing the time needed by the heating device to reach the preheating time, which is basically about 3-4 seconds, so that the user has a feeling of in-time smoking.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

FIG. 4 is applied.

DETAILED DESCRIPTION

To make the purpose, the technical scheme and the advantages of the present disclosure more apparent, the present disclosure is described in further detail in conjunction with accompanying drawings and embodiments. It should be understood that the specific embodiments described hereinafter are merely to explain the present disclosure, but to limit the present disclosure.

It should be noted that each characteristic in the embodiments of the present disclosure can be combined with each other if no conflict is incurred and they are all within the scope of protection of the present disclosure. In addition, although the division of functional modules is performed in the device diagram and a logic order is shown in the flowchart, in some cases, the shown or described steps may be executed by a different device division than in the device or in a different order than shown in the flowchart. Moreover, terms such as "first" "second" used in the present disclosure do not limit data or execution sequence, but merely distinguish same items or similar items with basically same functions and effects.

Common heated non-combustion electronic cigarettes mainly heat smoking articles at a low temperature through heating devices arranged inside the electronic cigarettes; the heating device employs a resistor heating method to bake the smoking article to form a flavor, thus achieving an inhaling effect close to real tobaccos. Therefore, for this kind of electronic cigarettes, the temperature control of low-temperature heating is an important factor to affect the smoking effect of electronic cigarettes.

Figure 1:
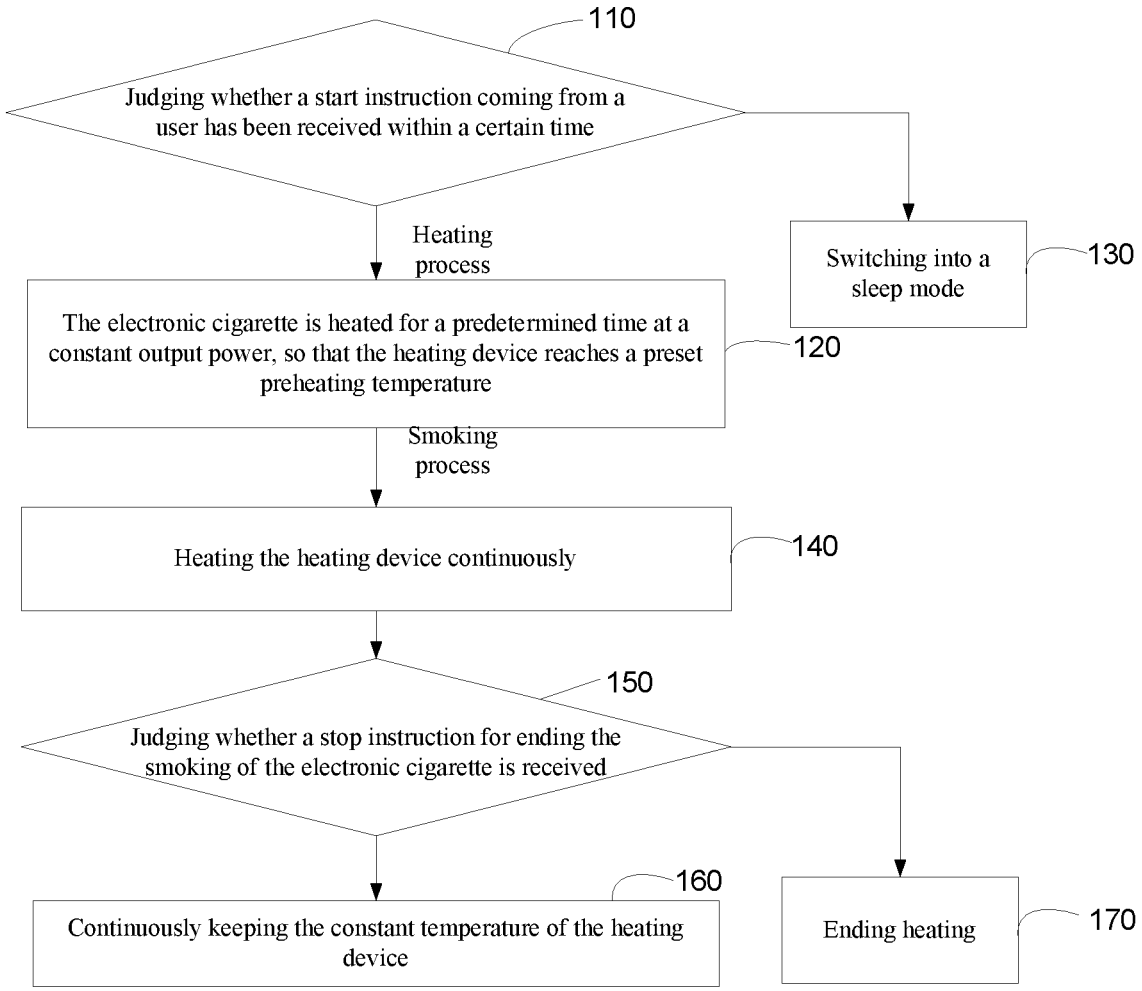
FIG. 1 is a flowchart of a temperature control method for a heating device in a conventional heated non-combustion electronic cigarette provided in an embodiment of the present disclosure.

FIG. 1 shows a temperature control method for a heating device in a conventional heated non-combustion electronic cigarette. As shown in FIG. 1, the control method may mainly include the following steps.

Step 110: when the electronic cigarette is in an idle state, judging whether a start instruction coming from a user has been received within a certain time. If so, executing Step 120; otherwise, executing Step 130.

Step 120: the electronic cigarette is heated for a predetermined time (for example, 20 seconds or 40 seconds) at a constant output power, so that the heating device reaches a preset preheating temperature gradually.

The preset temperature is the smoking article preheating phase in the smoking process of the electronic cigarette. In this phase, the smoking article needs a high temperature to achieve a baking and carbonization effect, so that the smoking article generates an aerosol.

Step 130: switching the electronic cigarette into a sleep mode so as to reduce the power consumption of the electronic cigarette.

Step 140: during the smoking process, heating the heating device continuously, so that the hating device keeps a constant temperature to heat the smoking article.

Step 140 is a smoking process of the electronic cigarette. In the smoking phase, the smoking article has been in an aerosolization state; it is only needed to keep a certain temperature to make the smoking article generate an aerosol continuously, thereby ensuring the smoking by the user.

Step 150: judging whether a stop instruction for ending the smoking of the electronic cigarette is received. If not, executing Step 160; otherwise, executing Step 170.

Step 160: continuously keeping the constant temperature of the heating device.

Step 170: ending heating.

With the heating control method shown in FIG. 1, the electronic cigarette consumes a long time in the preheating phase, the smoking article cannot generate an aerosol in time, and the response time is long from the time the smoking switching is activated to the time the user inhales the aerosol, which seriously affects the smoking experience of the user when using the electronic cigarette. In order to further improve the smoking experience of electronic cigarettes, the control method of the electronic cigarette provided by the embodiment of the present disclosure may be adopted to perform a fine adjustment on the temperature of the heating device, thereby ensuring the smoking experience of users.

Figure 2:
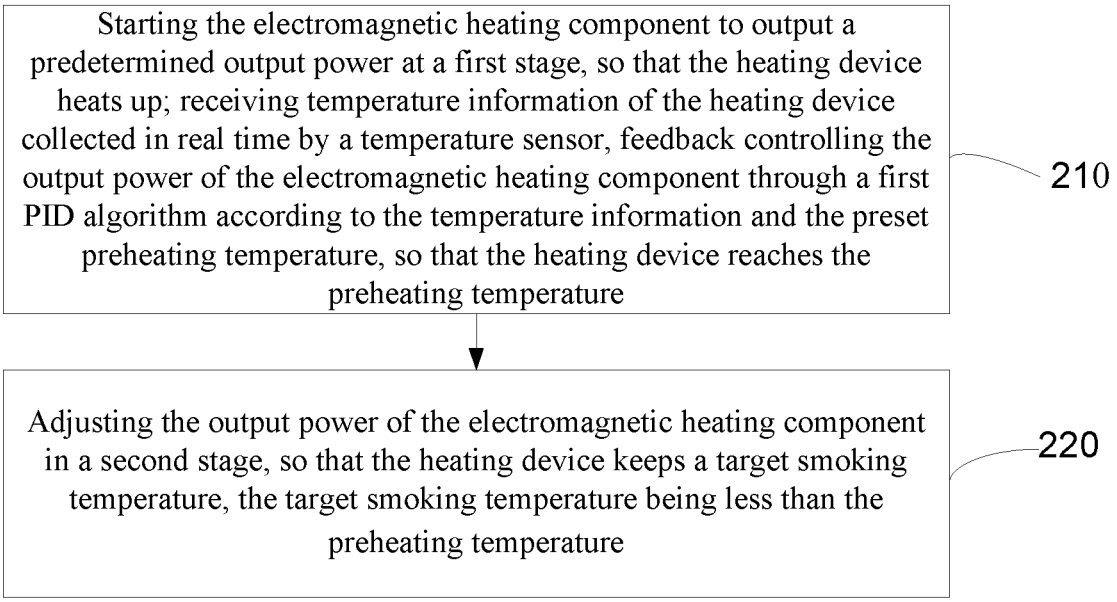
FIG. 2 is a flowchart of a control method of an electronic cigarette provided in an embodiment of the present disclosure.

In view of the above, the embodiment of the present disclosure provides a control method of an electronic cigarette, which can effectively reduce the time required by the electromagnetic heating component to heat the smoking article so as to generate an aerosol. Referring to FIG. 2, FIG. 2 is a flowchart of a control method of an electronic cigarette provided in an embodiment of the present disclosure. As shown in FIG. 2, the method includes the following steps.

Step 210: activating the electromagnetic heating component to output a predetermined output power at a first stage, so that the heating device heats up; receiving temperature information of the heating device collected in real time by a temperature sensor, feedback controlling the output power of the electromagnetic heating component through a first PID algorithm according to the temperature information and the preset preheating temperature, so that the heating device reaches the preheating temperature.

The heating device has a preset preheating temperature to which the heating device needs to reach, and the preheating temperature is greater than a critical temperature at which a tobacco material in the smoking article is heated to aerosolize.

The preheating temperature is an empirical numerical value, and in principle the preheating temperature is greater than a critical temperature at which a tobacco material in the smoking article is heated to aerosolize. The preheating temperature is related to specific conditions such as actually used smoking articles. Since there is difference between the critical temperatures at which tobacco materials in different types of smoking articles are heated to aerosolize, the preheating temperatures are different too. For example, the critical temperature of a certain type of smoking article is about 220 degrees centigrade, so the preheating temperature may be set to 250 degrees centigrade. Technical personnel can set a preheating temperature according to actual conditions. Generally, the above preheating temperature is set between 200 and 350 degrees centigrade.

Since the preheating temperature is greater than a critical temperature at which a tobacco material in the smoking article is heated to aerosolize, the electromagnetic heating component can rapidly heat the smoking article to generate an aerosol in the first stage. The preheating time is shortened compared with the prior art.

The first stage is a phase in which the heating device is heated rapidly. The heating device is a member which generates heat when heated, which can choose a material with good thermal conductivity, for example, metal sheet. The heating method for the heating device is one factor to affect the heating efficiency. Therefore, in the present embodiment, the heating device is heated employing an electromagnetic heating method, that is, the heating device will generate an eddy current to heat under the alternating magnetic field of the induction coil; this heating method makes a higher temperature rise efficiency for the heating device, then the heating device can reach the preheating temperature more rapidly, so that the smoking article contacting the heating device generates an aerosol.

In order to make the heating device heated from a normal temperature to the preheating temperature in a short time, generally the output power of the electromagnetic heating component is the maximum power at the first stage. In some embodiments, it is possible to control the induction coil to generate an alternating magnetic field of a first frequency, so as to control the output power of the electromagnetic heating component. The first frequency generally is the maximum frequency of the coil.

The temperature information is the current temperature data of the heating device collected and acquired by the temperature sensor. The temperature data specifically may be collected and acquired by any type of appropriate temperature sensor, and may be transmitted in the form of analog or data signal.

In the present embodiment, the output power of the electromagnetic heating component may be dynamically adjusted using the PID algorithm in conjunction with the temperature information sampled and acquired by the temperature sensor and the target preheating temperature, so that the heating device reaches the target preheating temperature more quickly.

Herein, the preheating temperature is a steady state that the PID algorithm is to achieve, and the continuously input temperature information is an input value of the PID algorithm.

The PID algorithm is a typical closed-loop feedback control method, which can realize a closed-loop control of a system through adjusting parameters of P (portion), I (integral) and D (differential), thereby keeping a certain steady state. In the PID algorithm, different settings of the three parameters may allow the PID algorithm to have corresponding performances.

The first PID algorithm is a PID algorithm with a rapid response speed that is employed to raise the speed to reach the preheating temperature (that is, steady state) as far as possible, and it can perform a feedback control on the output power of the heating device to achieve a rapid response speed. For example, through a higher proportion parameter, the first PID algorithm can control the heating device to rapidly reach the preheating temperature from a normal temperature using a high output power. In the present embodiment, the first stage has a duration of about 3 to 4 seconds.

In the present embodiment, the term "the PID algorithm with a rapid response speed" is used to represent a PID algorithm that controls the heating device employing a high output power. It should be noted that the "rapid" in the embodiment of the present disclosure is a concept relative to an ordinary PID algorithm. That is to say, in possible conditions, under the premise of meeting the basic PID algorithm feedback control, the time for the PID algorithm to reach the steady state is reduced as far as possible.

Step 220: adjusting the output power of the electromagnetic heating component in a second stage, so that the heating device keeps a target smoking temperature, the target smoking temperature being less than the preheating temperature.

The second stage is a smoking phase, that is, the electromagnetic heating component keeps within the scope of the target smoking temperature, to enable a temperature at which the smoking article can be heated to continuously generate an aerosol.

In view of the smoking phase, the heating device generally employs constant temperature control. After reaching the preset preheating temperature, the control method of the electronic cigarette can further include: controlling the heating device to keep a target smoking temperature during a smoking process through a second PID algorithm, wherein the second PID algorithm is a PID algorithm with a slow response speed. The response speed of the first PID algorithm is greater than the response speed of the second PID algorithm.

After the preheating temperature is reached, it is no longer urgent for the heating device to achieve the steady state more quickly. Therefore, it is possible to employ a PID algorithm with a slow response speed relative to the preheating phase to keep the heating device maintained at the required steady state (that is, the set temperature).

In the present embodiment, the second stage can also control the output power of the electromagnetic heating component through controlling the induction coil to generate an alternating magnetic field of a second frequency, so that the heating device is maintained at the required steady state (that is, the set temperature). Herein, it should be noted that since the preheating temperature is greater than a critical temperature at which a tobacco material in the smoking article is heated to aerosolize, the second frequency is less than the first frequency.

In the present embodiment, in order to provide a better smoking experience, the whole smoking process of the electronic cigarette can be divided into a plurality of phases, each of which has a corresponding target smoking temperature.

Through fragmenting the whole smoking process into multiple different phases and finely adjusting the smoking temperature of each phase, a better smoking feeling can be achieved for the user. It should be noted that the specific phase division and the smoking temperature set for each phase are a parameter value that is personalized or set according to actual usage conditions. The smoking temperature set for each phase can be determined through collecting a large amount of user data or through experiments. For specific settings, the above target smoking temperature may be close to or slightly greater than a critical temperature at which a tobacco material in the smoking article is heated to aerosolize, and can fluctuate at different smoking phases according to the critical temperature.

For example, the whole smoking process can be divided into 5 phases. The first phase is of 220 degrees centigrade, the second phase is of 225 degrees centigrade, the third phase is of 230 degrees centigrade, the fourth phase is of 225 degrees centigrade, and the fifth phase is of 220 degrees centigrade, which form a normal distribution curve.

The control method of the electronic cigarette provided in the embodiment of the present disclosure adopts a combination of PID algorithms and electromagnetic heating, thereby effectively reducing the time needed by the heating device to reach the preheating time, which is basically about 4 seconds, that is to say, the time required by the tobacco material in the smoking article to be heated to aerosolize is reduced, so that the user has a feeling of in-time smoking. Further, the present embodiment further fragments the constant temperature control in the smoking phase into multiple different stages, and performs a fine control for each phase using the PID algorithm, thereby providing a better smoking experience for the user.

Figure 3:
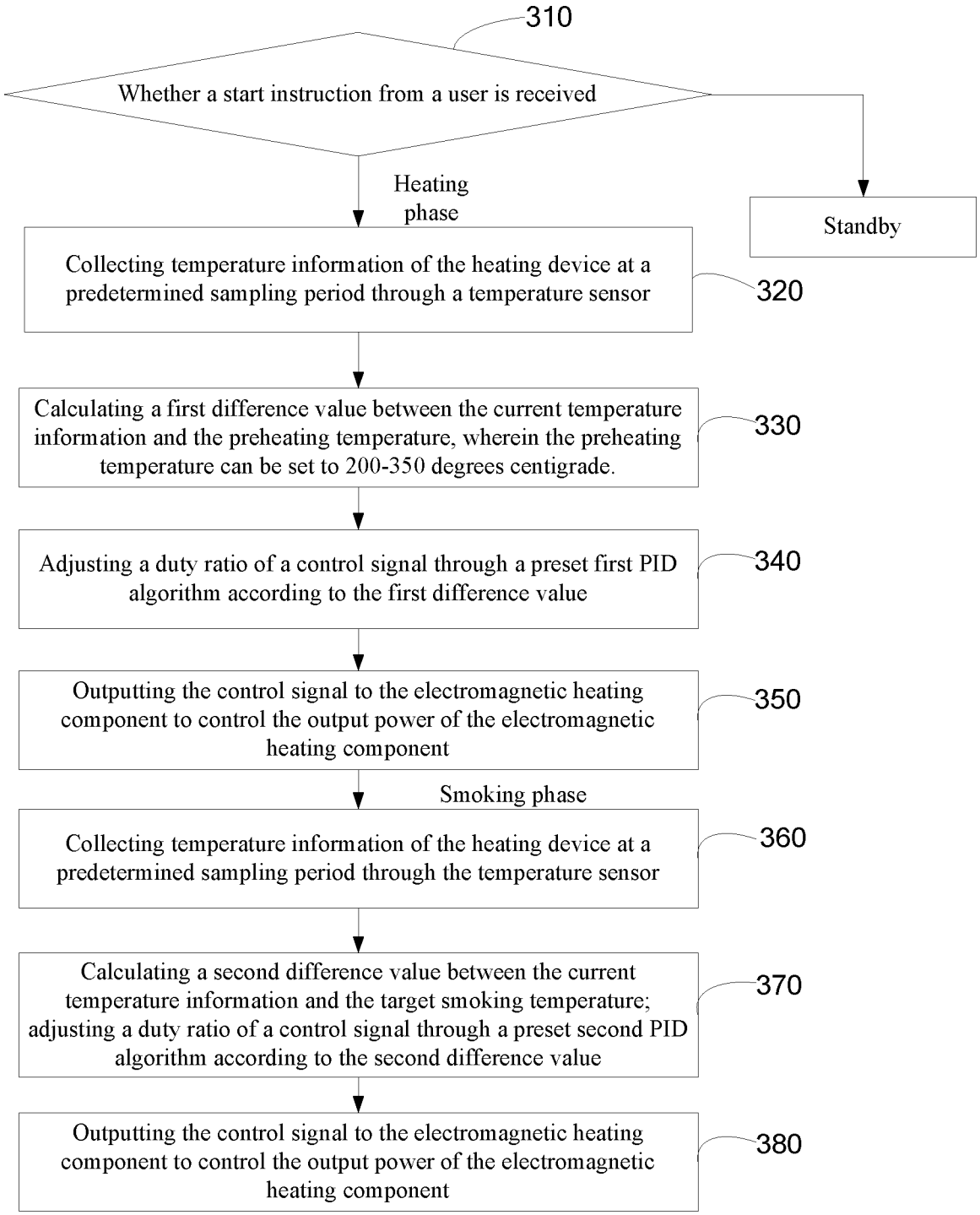
FIG. 3 is a flowchart of a control method of an electronic cigarette provided in another embodiment of the present disclosure.

Based on the application idea discovered in the above method embodiment, FIG. 3 is a specific example of controlling a duty ratio through a PID algorithm to implement a control method of an electronic cigarette according to an embodiment of the present disclosure. As shown in FIG. 3, a heating body of an electronic cigarette is controlled through the following methods.

At the preheating phase:

Step 310: judging whether a start instruction from a user is received; if so, executing Step 320 to start a heating device; otherwise, keeping standby.

The start instruction is an instruction issued by a user, indicating he/she wants to heat a smoking article and smoke the electronic cigarette. Specifically, the instruction can be collected by any type of appropriate input device, including, but not limited to, a button, a touch screen, a knob or a toggle switch and the like.

Step 320: collecting temperature information of the heating device at a predetermined sampling period through a temperature sensor.

Specifically, the sampling period is set by actual electronic cigarettes, as long as the usage requirements can be met. Of course, a quicker sampling period generally can bring a better control precision.

Step 330: calculating a first difference value between the current temperature information and the preheating temperature. In the present embodiment, the preheating temperature can be set to 200-350 degrees centigrade.

Step 340: adjusting a duty ratio of a control signal through a preset first PID algorithm according to the first difference value.

In the present embodiment, the first PID algorithm controls the output power through adjusting a duty ratio of a control signal, thereby achieving a feedback closed-loop adjustment. The first PID algorithm is a PID algorithm with a rapid response speed, which employs a more radical method and controls the electromagnetic heating component to quickly reach the steady state with a high output power.

Step 350: outputting the control signal to the electromagnetic heating component to control the output power of the electromagnetic heating component.

Through adjusting the duty ratio of the control signal, the ratio of activating time and inactivating time of the electromagnetic heating component can be changed, thereby adjusting the output power of the electromagnetic heating component until the heating device reaches the preheating temperature.

At the smoking phase:

Step 360: collecting temperature information of the heating device at a predetermined sampling period through the temperature sensor. Similarly, in order to realize phased temperature control, the heating device also needs to continuously sample temperature information at the smoking phase.

Step 370: calculating a second difference value between the current temperature information and the target smoking temperature; adjusting a duty ratio of a control signal through a preset second PID algorithm according to the second difference value.

As described above, a corresponding target smoking temperature can be set for each different phase, so as to realize a fine adjustment of the smoking phase.

At the smoking phase, a different PID control policy than the preheating phase is employed. The second PID algorithm is a PID algorithm with a slow response speed. The steady state adjustment of each phase is implemented through controlling a low output power of the electromagnetic heating component.

Step 380: outputting the control signal to the electromagnetic heating component to control the output power of the electromagnetic heating component.

Figure 4:
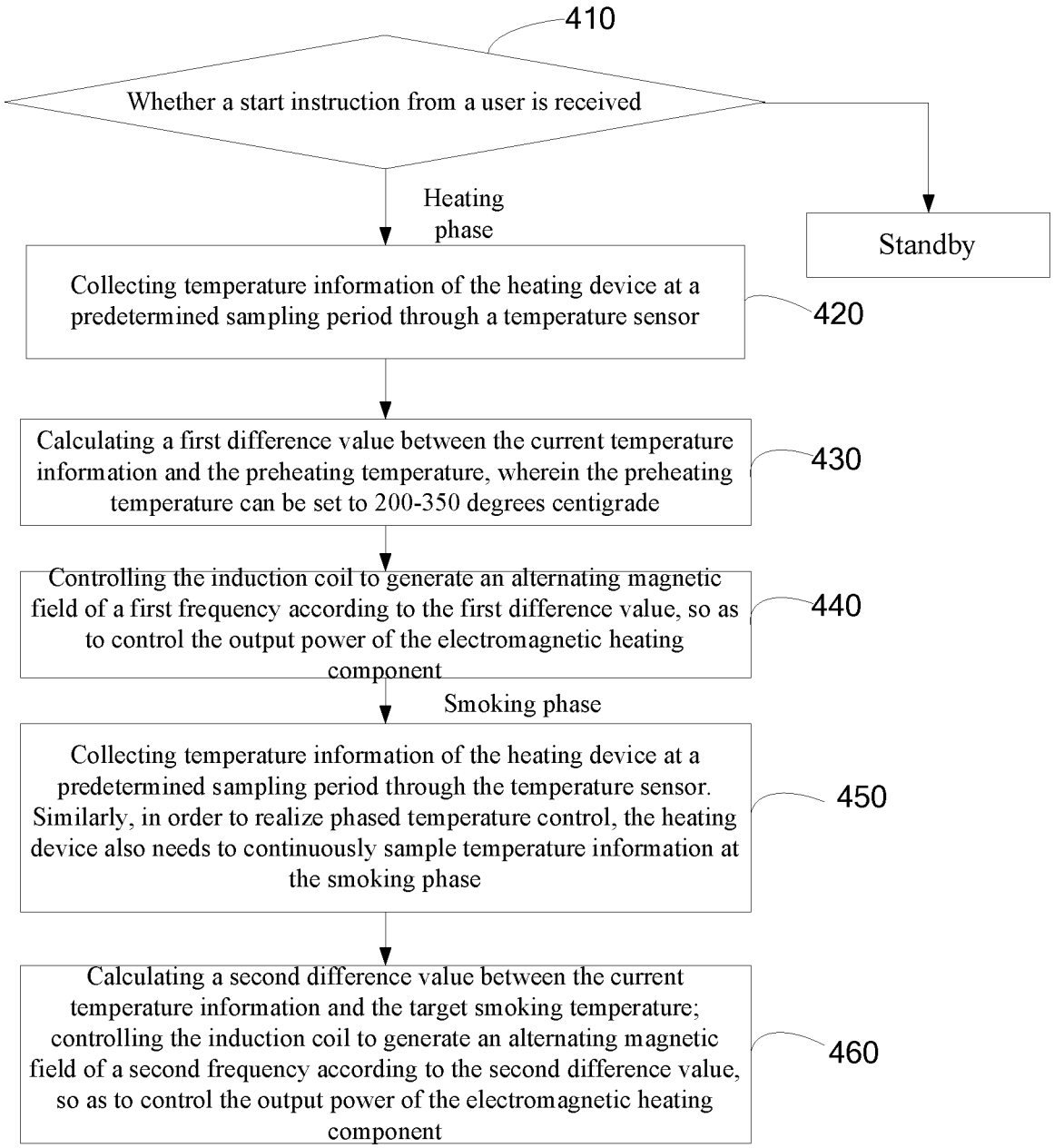
FIG. 4 is a flowchart of a control method of an electronic cigarette provided in another embodiment of the present disclosure.

Based on the application idea discovered in the above method embodiment, FIG. 4 is a specific example of controlling an induction coil in an electromagnetic heating component to generate an alternating magnetic field of a first frequency to implement a control method of an electronic cigarette according to an embodiment of the present disclosure. As shown in FIG. 4, a heating body of an electronic cigarette is controlled through the following methods.

At the preheating phase:

Step 410: judging whether a start instruction from a user is received; if so, executing Step 420 to start a heating device; otherwise, keeping standby.

The start instruction is an instruction issued by a user, indicating he/she wants to heat a smoking article and smoke the electronic cigarette. Specifically, the instruction can be collected by any type of appropriate input device, including, but not limited to, button, touch screen, knob or toggle switch and the like.

Step 420: collecting temperature information of the heating device at a predetermined sampling period through a temperature sensor.

Specifically, the sampling period is set by actual electronic cigarettes, as long as the usage requirements can be met. Of course, a quicker sampling period generally can bring a better control precision.

Step 430: calculating a first difference value between the current temperature information and the preheating temperature. In the present embodiment, the preheating temperature can be set to 200-350 degrees centigrade.

Step 440: controlling the induction coil to generate an alternating magnetic field of a first frequency according to the first difference value, so as to control the output power of the electromagnetic heating component.

Through adjusting the duty ratio of the control signal, the start-stop time ratio of the electromagnetic heating component can be changed, thereby adjusting the output power of the electromagnetic heating component until the heating device reaches the preheating temperature.

At the smoking phase:

Step 450: collecting temperature information of the heating device at a predetermined sampling period through the temperature sensor. Similarly, in order to realize phased temperature control, the heating device also needs to continuously sample temperature information at the smoking phase.

Step 460: calculating a second difference value between the current temperature information and the target smoking temperature; controlling the induction coil to generate an alternating magnetic field of a second frequency according to the second difference value, so as to control the output power of the electromagnetic heating component.

As described above, a corresponding target smoking temperature can be set for each different phase, so as to realize a fine adjustment of the smoking phase. At the smoking phase, the steady state adjustment of each phase is implemented through controlling a low output power of the electromagnetic heating component.

It should be noted that FIG. 3 adjusts the duty ratio through a PID algorithm to control the output powers of the electromagnetic heating component at the first stage and the second stage and FIG. 4 controls the induction coil to generate different frequencies of alternating magnetic fields to control the output powers of the electromagnetic heating component at the first stage and the second stage. The above two control methods may be used separately or in a combination to control the output powers of the electromagnetic heating component at the first stage and the second stage, which is not limited in the present embodiment.

Figure 5:
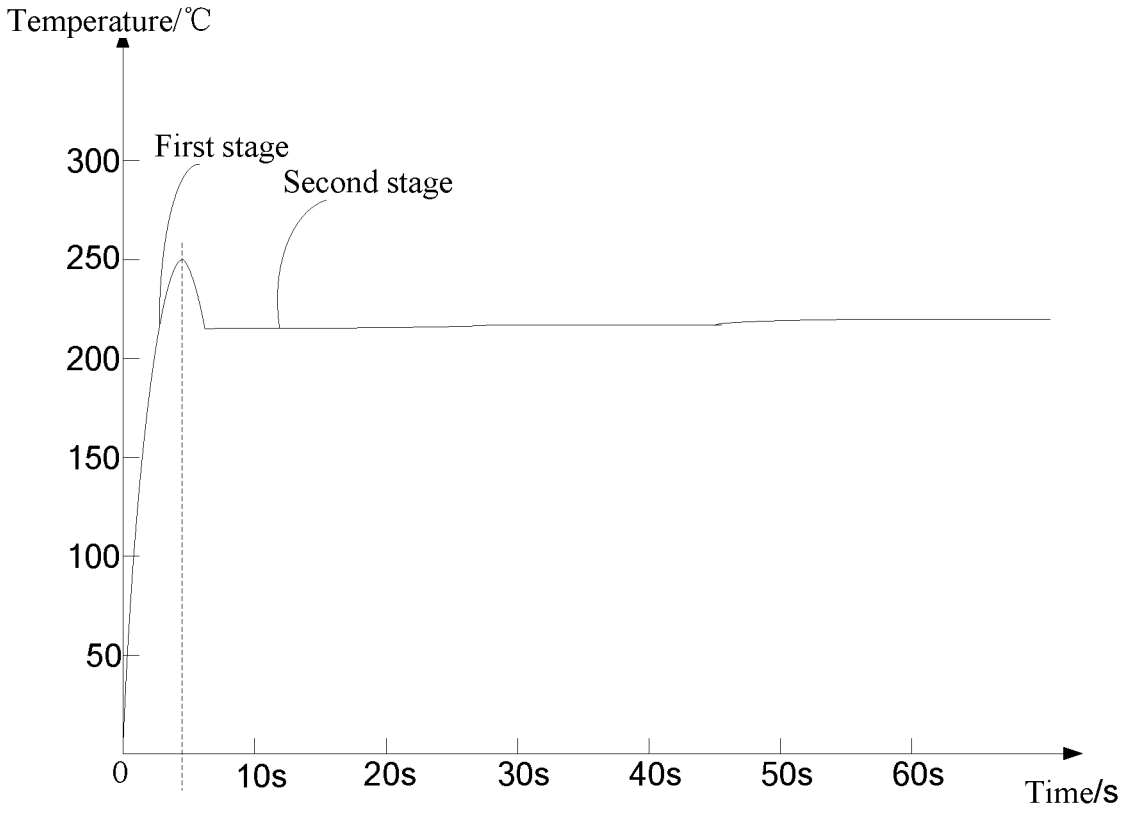
FIG. 5 is a diagram of a scenario in which a temperature of a heating device changes with time when the specific example shown in FIG. 3

FIG. 5 is a diagram of a scenario in which a temperature of a heating device changes with time when the specific example shown in FIG. 3 or FIG. 4 is applied. As shown in FIG. 5, the temperature of the heating device quickly rises to a preheating temperature of 250 degrees centigrade within a short time, that is, in the first stage, so that the smoking article generates an aerosol, so the time the consumer needs to wait before smoking is effectively reduced. Then, in order to avoid persistently high-temperature heating the smoking article to cause problems of burning or scorching and to make the duration of the aerosolization maintained a long time, when the temperature lowers to about 220 degrees centigrade at the second stage, heat to generate an aerosol and basically maintain this temperature to continuously generate an aerosol.

Based on the above control method, the embodiment of the present disclosure further provides an electronic cigarette applying the above control method. Based on the control method provided in the embodiment of the present disclosure, the electronic cigarette can quickly reach a preheating temperature and achieve a fragmentation of the smoking phases, thereby providing a better smoking feeling for users.

Figure 6:
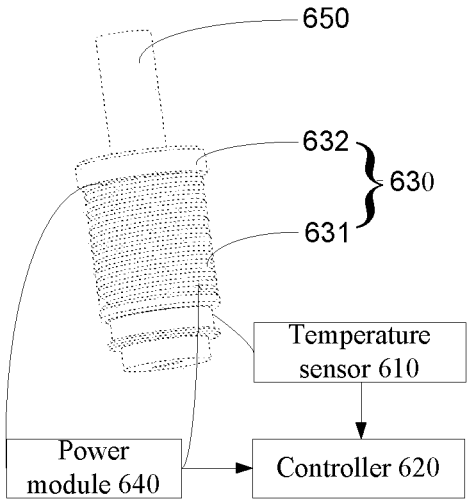
FIG. 6 is a structure diagram of an electronic cigarette provided in an embodiment of the present disclosure.

The embodiment of the present disclosure further provides an electronic cigarette. Referring to FIG. 6, FIG. 6 is a structural diagram of an electronic cigarette provided in an embodiment of the present disclosure. The electronic cigarette 600 includes the following components: a temperature sensor 610, a controller 620, an electromagnetic heating component 630 and a power module 640. The electromagnetic heating component 630 includes an induction coil 631 and a heating device 632.

The induction coil 631 is wound on the periphery of the heating device 632; when the induction coil 631 is electrified, the heating device 632 is heated to output heat, so as to heat a smoking article 650 placed inside the electronic cigarette; the smoking article 650 may be various types of smoking articles commonly used by non-combustion heated electronic cigarettes.

The temperature sensor 610 can be arranged at a proper position on the electronic cigarette 600, to detect the temperature information of the heating device 632, that is, the current temperature of the electromagnetic heating component 630. The induction coil 631 is the core to heat or provide heat, which heats the heating device 632 with a predetermined output power; obviously, the higher the output power, the quicker the temperature rise speed of the heating device 632.

The controller 620 is the control core of the whole electronic cigarette, and specifically may employ any type of electric computing platform or integrated chip that can realize logic computations. The controller 620 is connected to the temperature sensor 610 and the power module 640 respectively, and two electrodes of the power module 640 are electrically connected to two ends of the induction coil 631.

The temperature sensor 610 transmits the detected temperature information of the heating device 632 to the controller 620, then the controller 620 can feedback control the electrification time of the power module 640 through a first PID algorithm or control the induction coil 631 to generate a magnetic field of a preset frequency to control the output power, according to the temperature information and the preset preheating temperature, so that the heating device 632 reaches the preheating temperature.

Herein, the controller 620 feedback controls the heating device 632 to reach the preheating temperature according to a first PID algorithm at the first stage. The controller enables the heating device 632 to quickly reach a preheating temperature through a high power control method, so as to heat the smoking article to generate an aerosol, thereby providing a good smoking experience.

The controller 620 feedback controls the heating device 632 to reach a target smoking temperature according to a second PID algorithm at the second stage. In the present embodiment, the whole smoking process is divided into multiple phases, each of which has a corresponding target smoking temperature, and the constant temperature is changed into a fragmentation management. A control policy opposite to the first PID algorithm is employed to perform control. At the second stage, the heating device 632 needs to keep a corresponding target smoking temperature through a low power control method.

In some other embodiments, in order to realize functions such as start and shutdown, the electronic cigarette may further include a start switch (not shown).

The start switch is connected to the controller 620 and is used for receiving a start instruction coming from a user and transmitting the start instruction to the controller 620, so that the controller 620 starts the electromagnetic heating component to output a predetermined output power according to the start instruction. The start switch 45 specifically may be implemented employing any type of appropriate input device, including, but not limited to, button, knob or touch button and the like.

It is noteworthy that, besides executing the above steps, the controller 620 also executes other steps listed in the embodiments of the control method of the electronic cigarette.

Figure 7:
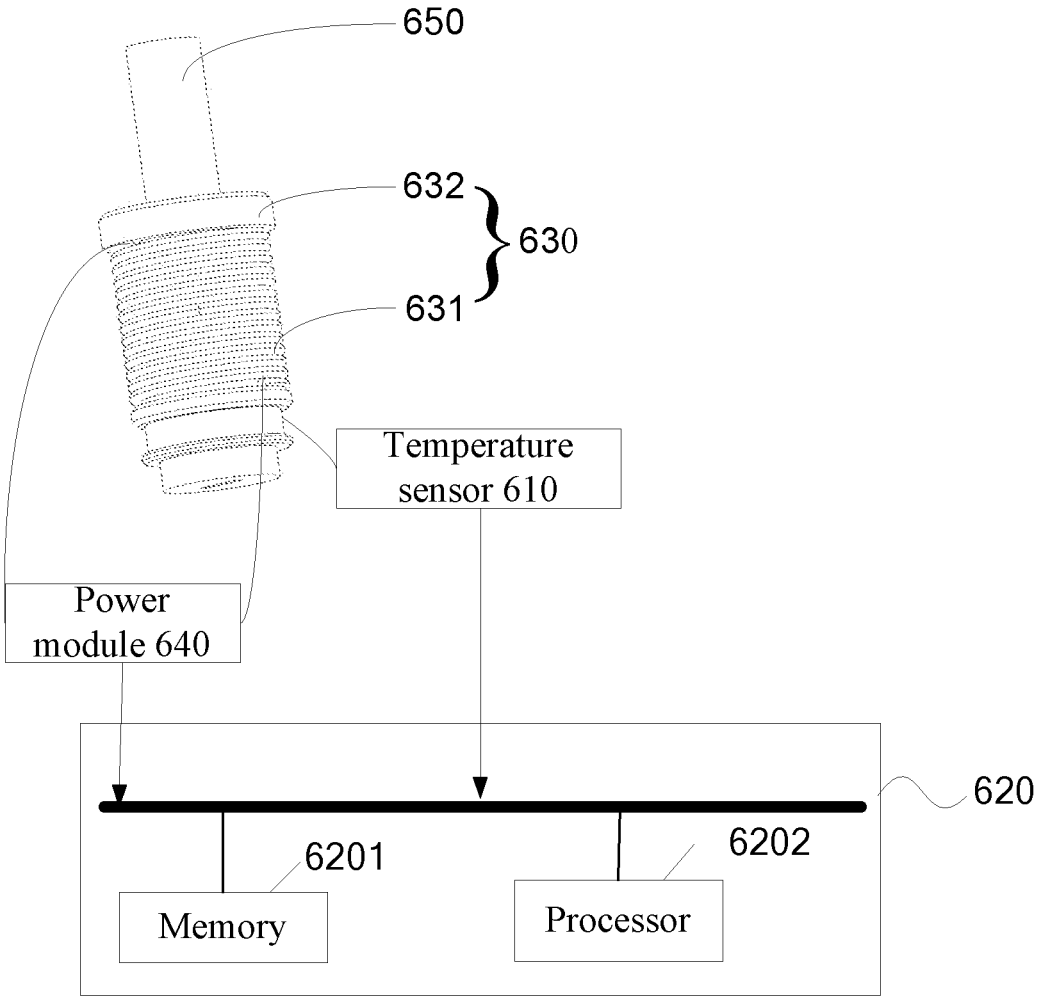
FIG. 7 is a structure diagram of an electronic cigarette provided in another embodiment of the present disclosure.

In some embodiments, as shown in FIG. 7, the controller 620 includes one or more processors 6202 and a memory 6201. FIG. 7 takes one processor for example.

The processor 6202 and the memory 6201 may be connected through a bus or other modes, and FIG. 7 takes a bus connection for example.

The memory 6201, as a non-volatile computer readable storage medium, may be used for storing non-volatile software programs, non-volatile computer executable programs and modules, for example, the program instruction/module executed by the controller 620 in the embodiment of the present disclosure. The processor 6202 executes various function application and data processing of a server, that is, implementing the method executed by the controller 620 in the above method embodiment, through running the non-volatile software programs, instructions and modules stored in the memory 620.

The memory 6201 may include a program storage area and a data storage area, wherein the program storage area can store the application needed by an operating system or at least one function, and the data storage area can store data and the like. In addition, the memory 6201 may include a high speed random access memory, and may further include a non-volatile memory, for example, at least one disk storage device, a flash memory device or other solid-state non-volatile storage devices. In some embodiments, the memory 6201 optionally includes a remote memory relative to the processor 6202. The above network instances include but not limited to Internet, intranet, local area network, mobile communication network and combinations thereof.

The one or more modules are stored in the memory 6201 and will execute the method executed by the controller 620 in any of the above method embodiments when executed by the one or more processors 6202.

The above product can execute the method provided by the embodiment of the present disclosure and has corresponding function modules and beneficial effects to execute the method. Technical details that are not described in detail in the present embodiment can refer to the method provided by the embodiment of the disclosure.

The electronic device in the embodiment of the present disclosure exists in many forms, including but not limited to:

Mobile communication equipment, which has mobile communication functions and has a main goal to provide voice and data communication. This type of terminal includes intelligent phones (iPhone), multimedia phones, functional phones, low-end phones, and the like.

Ultra-mobile personal computer devices, which belong to the scope of personal computers, have functions of computing and processing, and generally have a mobile internet feature. This type of terminal includes PDA, MID, UMPC devices and the like, for example, iPad.

Portable entertainment equipment, which can display and play multimedia contents. This type of equipment includes audio and video players (for example, iPod), handheld devices, electronic books, intelligent toys, and portable vehicle navigation devices.

Servers, which are equipment providing computing services. The server is composed of a processor, a hard disk, a memory, a system bus and so on. The server is similar to a general computer in architecture. Due to the need to provide highly reliable services, the server has higher demands on processing capability, stability, reliability, safety, expandability, manageability and so on.

Other electronic devices that have data interaction functions.

The embodiment of the present disclosure provides a nonvolatile computer readable storage medium, the computer readable storage medium stores a computer executable instruction, and the computer executable instruction is executed by one or more processors to implement the steps in the above embodiments of the control method of the electronic cigarette. The embodiment of the present disclosure provides a computer program product, the computer program product includes a computer program stored in a nonvolatile computer readable storage medium, and the computer program includes a program instruction, which, when executed by a computer, causes the computer to execute the steps in the embodiments of the control method of the electronic cigarette.

It is understandable that, on the basis of the electronic cigarette provided in the embodiment of the present disclosure, those skilled in the art can add or remove one or more functional modules to realize corresponding functions according to the requirement of actual conditions, so as to meet different actual requirements.

The electronic cigarette provided in the embodiment of the present disclosure adopts a combination of PID algorithms and electromagnetic heating, thereby effectively reducing the time needed by the heating device to reach the preheating time, which is basically about 4 seconds, so that the user has a feeling of in-time smoking. Further, the electronic cigarette further fragments the constant temperature control in the smoking phase into multiple different stages, and performs a fine control for each phase using the PID algorithm, thereby providing a better smoking experience for the user.

The device or equipment embodiments described above are merely for illustration. The unit module described as a separate component may be or may not be physically separated; the component, displayed as a unit, may be or may not be a physical unit, that is, it may be located at one place, or may be distributed on a plurality of network module units. Part or all modules may be selected to realize the purpose of the embodiment scheme according to actual needs.

Through the description of the above implementations, those skilled in the art can clearly understand that each implementation can be achieved by means of software plus a common hardware platform, of course as well as through hardware. Based on this understanding, the above technical scheme on essence or the part making a contribution to relevant technologies can be embodied in the form of software product. This computer software product is stored in a computer readable storage medium, for example ROM/RAM, diskette or compact disc, etc., including a number of instructions that enables a computer device (which might be a personal computer, a server or a network device, etc.) to execute the method descried in each embodiment or in some parts of the embodiments.

Finally, it should be noted that the above embodiments are merely to illustrate the technical scheme of the present disclosure, but to limit it. Under the idea of the present disclosure, the above embodiments or technical features in different embodiments can be combined, the steps can be implemented in any order, there are many other changes to different aspects of the present disclosure as described above, and for simplicity, these changes are not provided in detail. Although the present disclosure is described in detail with reference to the foregoing embodiments, the ordinary skill in this field should understand that modifications can still be made to the technical scheme recorded in the above each embodiment or equivalent substitutions can be made to partial technical features; these modifications or substitutions do not make the essence of the corresponding technical scheme depart from the scope of the technical scheme of each embodiment of the present disclosure.

What is claimed is:

1. A control method of an electronic cigarette, which is used for controlling an electromagnetic heating component to heat a smoking article to produce an aerosol, the electromagnetic heating component at least comprising an induction coil and a heating device, the control method comprising:

determining a preheating temperature, the preheating temperature being greater than a critical temperature at which a tobacco material in the smoking article is heated to aerosolize;

activating the electromagnetic heating component to output a predetermined output power at a first stage, so that the heating device heats up;

receiving temperature information of the heating device collected in real time by a temperature sensor, feedback controlling the output power of the electromagnetic heating component through a first PID algorithm according to the temperature information and the preset preheating temperature, so that the heating device reaches the preheating temperature; and after the heating device reaches the preheating temperature, adjusting the output power of the electromagnetic heating component at a second stage, so that the heating device keeps a target smoking temperature, the target smoking temperature being less than the preheating temperature.

2. The control method of the electronic cigarette according to claim 1, wherein the first PID algorithm is a PID algorithm with a rapid response speed, and the first stage has a duration of 3 to 4 seconds.

3. The control method of the electronic cigarette according to claim 1, wherein the step of activating the electromagnetic heating component to output a predetermined output power at the first stage comprises: controlling the induction coil to generate an alternating magnetic field of a first frequency in a first stage, so that the electromagnetic heating component outputs a predetermined output power; and the step of adjusting the output power of the electromagnetic heating component at the second stage comprises: controlling the induction coil to generate an alternating magnetic field of a second frequency in the second stage, so as to control the output power of the electromagnetic heating component, the second frequency being less than the first frequency.

4. The control method of the electronic cigarette according to claim 2, wherein the step of feedback controlling the output power of the heating device through a first PID algorithm or a second PID algorithm comprises:

calculating a first difference value between the current temperature information and the preheating temperature;

adjusting a duty ratio of a control signal through a preset first PID algorithm according to the first difference value; and outputting the control signal to the electromagnetic heating component to control the output power; or, calculating a second difference value between the current temperature information and the target smoking temperature;

adjusting a duty ratio of a control signal through a preset second PID algorithm according to the second difference value; and outputting the control signal to the electromagnetic heating component to control the output power.

5. The control method of the electronic cigarette according to claim 1, wherein the preheating temperature is 200 to 350 degrees centigrade.

6. The control method of the electronic cigarette according to claim 5, wherein the step of feedback controlling the output power of the heating device through a first PID algorithm or a second PID algorithm comprises:

calculating a first difference value between the current temperature information and the preheating temperature;

adjusting a duty ratio of a control signal through a preset first PID algorithm according to the first difference value; and outputting the control signal to the electromagnetic heating component to control the output power; or, calculating a second difference value between the current temperature information and the target smoking temperature;

adjusting a duty ratio of a control signal through a preset second PID algorithm according to the second difference value; and outputting the control signal to the electromagnetic heating component to control the output power.

7. The control method of the electronic cigarette according to claim 1, further comprising:

receiving a start instruction from a user, and activating the electromagnetic heating component to output a predetermined output power according to the start instruction.

8. The control method of the electronic cigarette according to claim 1, wherein the step of adjusting the output power of the electromagnetic heating component at the second stage so that the heating device keeps a target smoking temperature specifically comprises:

controlling the heating device to keep a target smoking temperature during a smoking process through a second PID algorithm in the second stage; the smoking process being divided into a plurality of phases, each of which has a corresponding target smoking temperature, and the second PID algorithm being a PID algorithm with a slow response speed.

9. The control method of the electronic cigarette according to claim 8, wherein the step of controlling the heating device to keep a target smoking temperature during a smoking process through a second PID algorithm comprises:

collecting temperature information of the heating device at a predetermined sampling period through the temperature sensor; and feedback controlling the output power of the electromagnetic heating component through the second PID algorithm according to the temperature information and the target smoking temperature at the current phase, so that the heating device reaches the target smoking temperature.

10. The control method of the electronic cigarette according to claim 1, wherein the step of feedback controlling the output power of the heating device through a first PID algorithm or a second PID algorithm comprises:

calculating a first difference value between the current temperature information and the preheating temperature;

adjusting a duty ratio of a control signal through a preset first PID algorithm according to the first difference value; and outputting the control signal to the electromagnetic heating component to control the output power; or, calculating a second difference value between the current temperature information and the target smoking temperature;

adjusting a duty ratio of a control signal through a preset second PID algorithm according to the second difference value; and outputting the control signal to the electromagnetic heating component to control the output power.

11. The control method of the electronic cigarette according to claim 10, wherein the response speed of the first PID algorithm is greater than the response speed of the second PID algorithm.

12. An electronic cigarette comprising:

a temperature sensor configured for detecting temperature information of a heating device;

an electromagnetic heating component, configured for outputting a power to heat a smoking article placed in the electronic cigarette; the electromagnetic heating component at least comprising an induction coil and a heating device; and a controller connected to the temperature sensor and the electromagnetic heating component respectively and configured for feedback controlling the output power of the electromagnetic heating component through a first PID algorithm according to the temperature information and a preset preheating temperature for the heating device, so that the heating device reaches the preheating temperature.

13. The electronic cigarette according to claim 12, wherein the controller is further configured for feedback controlling the output power of the electromagnetic heating component through the first PID algorithm, so that the heating device reaches the preheating temperature, and is configured for feedback controlling the electromagnetic heating component to keep a target smoking temperature through the second PID algorithm.

14. The electronic cigarette according to claim 13, wherein the controller comprises:

at least one processor; and a memory in communication connection with the at least one processor;

wherein the memory stores an instruction that can be executed by the at least one processor, and the instruction is executed by the at least one processor so that the at least one processor can execute the steps executed by the controller.

15. The electronic cigarette according to claim 12, further comprising a start switch, wherein the start switch is connected to the controller; and is configured for receiving a start instruction from a user and transmitting the start instruction to the controller, so that the controller starts, according to the start instruction, the electromagnetic heating component to output a predetermined output power.

16. The electronic cigarette according to claim 12, wherein the controller comprises:

at least one processor; and a memory in communication connection with the at least one processor;

wherein the memory stores an instruction that can be executed by the at least one processor, and the instruction is executed by the at least one processor so that the at least one processor can execute the steps executed by the controller.

17. The electronic cigarette according to claim 15, wherein the controller comprises:

at least one processor; and a memory in communication connection with the at least one processor;

wherein the memory stores an instruction that can be executed by the at least one processor, and the instruction is executed by the at least one processor so that the at least one processor can execute the steps executed by the controller.

18. A computer program product, characterized in that, wherein the computer program product comprises a computer program stored in a nonvolatile computer readable storage medium, and the computer program comprises a program instruction, which, when executed by a computer, causes the computer to execute the method described in claim 1.

* * * * *